US010920692B2

(12) United States Patent
Choi

(10) Patent No.: US 10,920,692 B2
(45) Date of Patent: Feb. 16, 2021

(54) ACTIVE CANISTER PURGE SYSTEM AND METHOD FOR CONTROLLING THE SAME

(71) Applicants: Hyundai Motor Company, Seoul (KR); KIA Motors Corporation, Seoul (KR)

(72) Inventor: Choo Saeng Choi, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 118 days.

(21) Appl. No.: 16/171,622

(22) Filed: Oct. 26, 2018

(65) Prior Publication Data

US 2019/0211760 A1 Jul. 11, 2019

(30) Foreign Application Priority Data

Jan. 10, 2018 (KR) ..... 10-2018-0003168

(51) Int. Cl.
*F02D 41/00* (2006.01)
*F02M 25/08* (2006.01)
*F02M 35/10* (2006.01)

(52) U.S. Cl.
CPC ..... *F02D 41/0045* (2013.01); *F02D 41/0032* (2013.01); *F02M 25/089* (2013.01); *F02M 25/0836* (2013.01); *F02M 35/10222* (2013.01)

(58) Field of Classification Search
CPC ..... F02D 41/0045; F02D 41/0032; F02M 25/0836; F02M 25/089; F02M 35/10222; F02M 25/0809
USPC ..... 123/519
See application file for complete search history.

(56) References Cited

U.S. PATENT DOCUMENTS

2007/0246024 A1 10/2007 Sato
2013/0213366 A1* 8/2013 Weigl ..... F02M 25/089 123/520
2016/0069303 A1* 3/2016 Pursifull ..... F02D 41/0032 701/103
2017/0152814 A1* 6/2017 Casetti ..... F02M 25/0836
2018/0347511 A1* 12/2018 Makino ..... F02D 41/0032
2019/0113007 A1* 4/2019 Kato ..... F02D 41/0045

FOREIGN PATENT DOCUMENTS

JP 2007/205210 A 8/2007
JP 2007/218122 A 8/2007

* cited by examiner

*Primary Examiner* — Joseph J Dallo
*Assistant Examiner* — Scott A Reinbold
(74) *Attorney, Agent, or Firm* — Brinks Gilson & Lione

(57) ABSTRACT

An active canister purge system according to the present disclosure includes a canister that traps fuel vapor generated in a fuel tank, a purge control valve that purges the fuel vapor trapped in the canister to an intake system of an engine, a purge pump disposed downstream of the purge control valve, a differential pressure measurement device that measures a differential pressure of the purge control valve, and a controller that determines a target purge flow rate of the fuel vapor trapped in the canister, sets a target differential pressure corresponding to the target purge flow rate, and adjusts an RPM of the purge pump such that an actual differential pressure of the purge control valve, which is measured by the differential pressure measurement device, reaches the target differential pressure.

9 Claims, 4 Drawing Sheets

ACTIVE CANISTER PURGE SYSTEM AND METHOD FOR CONTROLLING THE SAME

CROSS-REFERENCE TO RELATED APPLICATION

This application claims priority to and the benefit of Korean Patent Application No. 10-2018-0003168, filed on Jan. 10, 2018, which is incorporated herein by reference in its entirety.

FIELD

The present disclosure relates to an active canister purge system and a method for controlling the active canister purge system in a vehicle.

BACKGROUND

The statements in this section merely provide background information related disclosure and may not constitute prior art.

Fuel stored in a fuel tank of a vehicle changes into fuel vapor as time passes. If the fuel vapor is discharged to the air, fuel may be wasted and air pollution may be occurred due to the release of unburned fuel. In order to address these drawbacks, the vehicle includes a canister purge system that purges the fuel vapor generated in the fuel tank to an intake system of the engine.

The canister purge system may include a canister that traps fuel vapor generated in the fuel tank and a purge control valve that purges the fuel vapor trapped in the canister to the intake system of the engine. The purge control valve may be opened by a controller, such as an engine control unit, an engine control module, or the like, under a purge control condition of the engine, that is, a condition in which a negative pressure of the engine is sufficiently formed, and the fuel vapor trapped in the canister may be purged to the intake system of the engine.

However, some engines, such as the TGDI HEV, may have a relatively insufficient negative pressure to deliver fuel vapor trapped in a canister to an intake system of the engines by using only the negative pressure of the engines. Accordingly, an active canister purge system having a purge pump that forcibly purges fuel vapor trapped in a canister to an intake system of an engine is applied to vehicles in which engines with an insufficient negative pressure are mounted.

In a conventional active canister purge system, a purge pump may be disposed between a purge control valve and a canister and may be driven to forcibly purge fuel vapor trapped in the canister to an intake system of an engine while the purge control valve is open.

The conventional active canister purge system includes the purge control valve driven according to a duty cycle, the purge pump disposed upstream of the purge control valve, and two pressure sensors separately provided upstream and downstream of the purge pump.

The two pressure sensors may separately measure pressure at an inlet side of the purge pump and pressure at an outlet side of the purge pump, and therefore a differential pressure of the purge pump (a difference between the pressure at the inlet side of the purge pump and the pressure at the outlet side of the purge pump) may be calculated.

In addition, a purge flow rate of fuel vapor may be determined by using an RPM of the purge pump and a differential pressure of the purge pump (a difference between the pressure at the inlet side of the purge pump and the pressure at the outlet side of the purge pump), and when a negative pressure is generated at the inlet side of the purge pump by driving the purge pump, the purge control valve may be driven according to a duty cycle set in advance to adjust a purge flow rate of fuel vapor purged to the intake system of the engine.

We have discovered, however, that the purge flow rate of the fuel vapor purged by the purge pump may significantly vary depending on the differential pressure of the purge pump under the same RPM condition of the purge pump since the purge pump is disposed upstream of the purge control valve in the conventional active canister purge system. For example, the purge flow rate of the fuel vapor purged by the purge pump may be 10 liters per minute (LPM) when the purge pump operates at 20000 RPMs and has a differential pressure of 2 kPa and may be liters per minute (LPM) when the purge pump operates at 20000 RPMs and has a differential pressure of 1 kPa. That is, the purge flow rate of the fuel vapor purged by the purge pump increases by 300%, whereas the differential pressure of the purge pump decreases by 1 kPa.

As described above, the conventional active canister purge system has disadvantages in that the purge flow rate of the fuel vapor purged by the purge pump significantly varies depending on the differential pressure change of the purge pump, and therefore it is difficult to accurately control the purge flow rate of the fuel vapor.

Furthermore, we have discovered that the conventional active canister purge system has shortcomings in that flow passage resistance at the inlet side of the purge pump varies depending on the length, path, inner diameter, and the like of a conduit connected to the inlet of the purge pump and the purge flow rate of the fuel vapor purged by the purge pump significantly varies due to the change in the flow passage resistance at the inlet side of the purge pump. Due to this, a purge flow rate has to be mapped onto each vehicle, and therefore it may be very troublesome to design an active canister purge system.

An active canister purge system needs to accurately control a purge flow rate to improve fuel economy and to prevent pollution. Especially, when an active canister purge system, along with a low-pressure EGR system, is applied to a vehicle, it is necessary to improve accuracy of a purge flow rate to calculate an accurate EGR rate.

The above information disclosed in this Background section is only for enhancement of understanding of the background of the present disclosure and therefore it may contain information that does not form the prior art that is already known to a person of ordinary skill in the art.

SUMMARY

The present disclosure relates to an active canister purge system for accurately controlling a purge flow rate of fuel vapor.

According to an aspect of the present disclosure, an active canister purge system includes a canister that traps fuel vapor generated in a fuel tank, a purge control valve that purges the fuel vapor trapped in the canister to an intake system of an engine, a purge pump disposed downstream of the purge control valve, a differential pressure measurement device that measures a differential pressure of the purge control valve, and a controller that determines a target purge flow rate of the fuel vapor trapped in the canister, sets a target differential pressure corresponding to the target purge flow rate, and adjusts an RPM of the purge pump such that an actual differential pressure of the purge control valve, which is measured by the differential pressure measurement device, reaches the target differential pressure.

The differential pressure measurement device may be a pressure sensor that measures pressure at an outlet side of the purge control valve.

The differential pressure measurement device may be a differential pressure sensor connected to an inlet side and an outlet side of the purge control valve.

The purge pump may be in communication with an intake pipe of the engine through a conduit.

The conduit may be connected to the intake pipe upstream of a charger.

A flow rate of the fuel vapor passing through the purge control valve may be determined based on the differential pressure of the purge control valve.

According to another aspect of the present disclosure, provided is a method for controlling an active canister purge system that includes a canister that traps fuel vapor generated in a fuel tank, a purge control valve that purges the fuel vapor trapped in the canister to an intake system of an engine, and a purge pump disposed downstream of the purge control valve, the method including setting a target differential pressure of the purge control valve when a purging condition for purging the fuel vapor from the canister to the intake system of the engine is satisfied while the engine is being driven and adjusting an RPM of the purge pump such that an actual differential pressure of the purge control valve reaches the target differential pressure.

The target differential pressure may be set based on a temperature compensation value.

The method may further include determining a target purge flow rate of the purge control valve when the purging condition is satisfied while the engine is being driven, wherein the target differential pressure is set to correspond to the determined target purge flow rate.

The method may further include measuring the actual differential pressure of the purge control system in real time by using a differential pressure measurement device.

The method may further include driving the purge control valve according to a duty cycle set in advance when the measured actual differential pressure of the purge control valve reaches the target differential pressure.

According to the present disclosure, a purge pump may be disposed downstream of a purge control valve along a purge flow direction of fuel vapor, and a negative pressure may be generated downstream of the purge control valve by driving the purge pump. Accordingly, a purge flow rate of the fuel vapor may be accurately controlled by adjusting the RPM of the purge pump according to a flow rate determined by the purge control valve.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
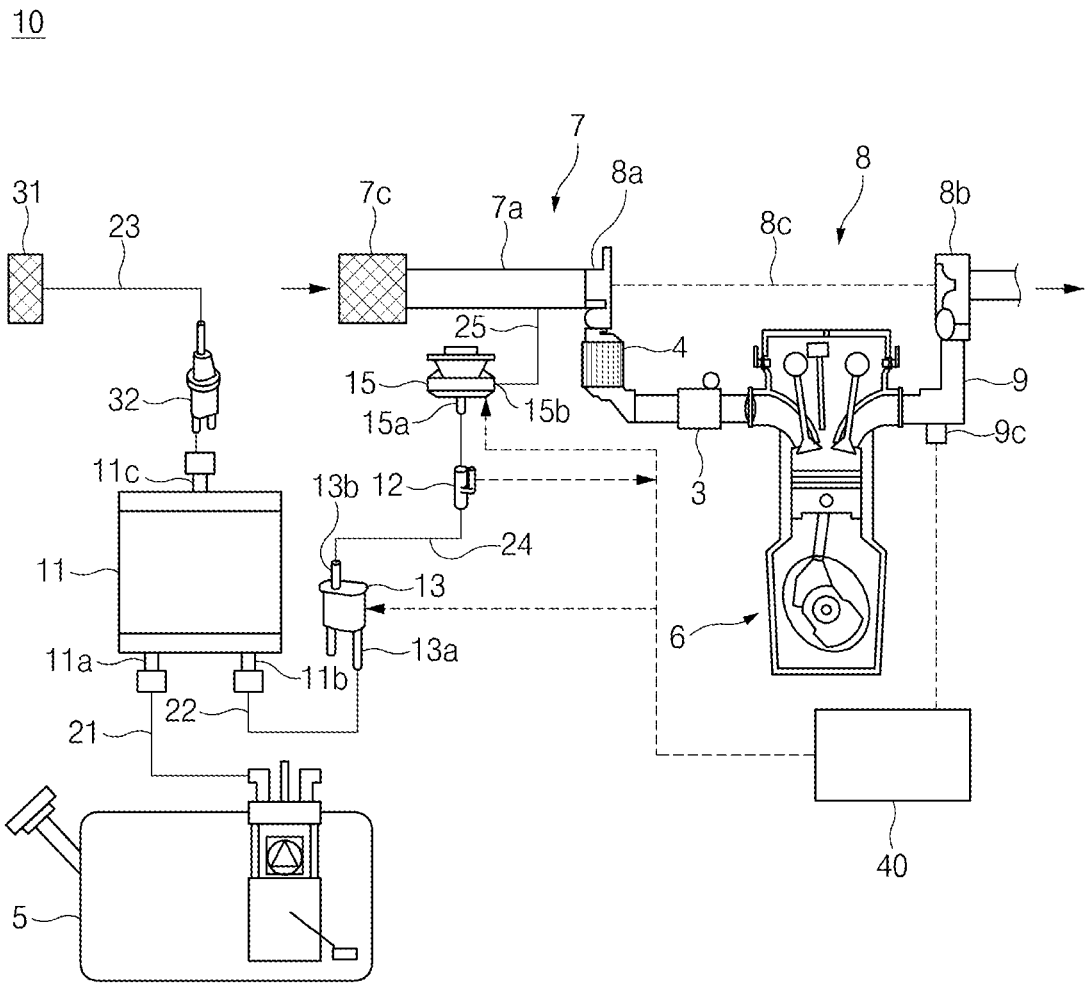
FIG. 1 illustrates a configuration of an active canister purge system according to a form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following descriptions, terms, such as "first", "second", "A", "B", "(a)", "(b)", and the like, may be used herein to describe elements of the present disclosure. Such terms are only used to distinguish one element from another element, and the substance, sequence, order, or number of these elements is not limited by these terms. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, an active canister purge system 10 according to a form of the present disclosure may include a canister 11 that traps fuel vapor generated in a fuel tank 5, a purge control valve 13 that purges the fuel vapor trapped in the canister 11 to an intake system 7 of an engine 6, and a purge pump 15 disposed downstream of the purge control valve 13.

The fuel tank 5 may be configured to store fuel, and the fuel in the fuel tank 5 may vaporize to change into fuel vapor.

The canister 11 may be connected to the fuel tank 5 through a first conduit 21, and the fuel vapor generated in the fuel tank 5 may be delivered to the canister 11 through the first conduit 21 and may be trapped in the canister 11. According to a form, the canister 11 may have activated-carbon.

The canister 11 may have an inlet port 11*a* through which the fuel vapor is introduced into the canister 11 and an outlet port 11*b* through which the fuel vapor is released from the canister 11. The inlet port 11*a* may be in communication with the first conduit 21, and the fuel vapor in the fuel tank 5 may be introduced into and trapped in the canister 11 through the inlet port 11*a*. The outlet port 11*b* may be in communication with a second conduit 22, and the fuel vapor trapped in the canister 11 may be released through the outlet port 11*b* so that the canister 11 may be purged.

The canister 11 may have a vent port 11*c* in communication with a third conduit 23, and an air inlet 31 may be provided at one end of the third conduit 23. The air inlet 31 may include an air filter. A canister close valve 32 for selectively opening/closing the vent port 11*c* may be provided on the third conduit 23. For example, the canister close valve 32 may be usually open and may be closed for a diagnosis of leakage.

The purge control valve 13 may be connected to the canister 11 through the second conduit 22 and may be disposed downstream of the canister 11 along the purge flow direction of the fuel vapor.

According to a form of the present disclosure, the purge control valve 13 may be implemented with a solenoid valve. Accordingly, the purge control valve 13 may be driven according to a duty cycle set in advance.

The purge control valve 13 may have an inlet port 13*a* and an outlet port 13*b*. The inlet port 13*a* of the purge control valve 13 may be in communication with the second conduit 22, and the outlet port 13*b* of the purge control valve 13 may be in communication with a fourth conduit 24. The flow rate of fuel vapor passing through the purge control valve 13 may be determined depending on a differential pressure of the purge control valve 13 (a difference between pressure at the inlet side of the purge control valve 13 and pressure at the outlet side of the purge control valve 13).

Figure 2:
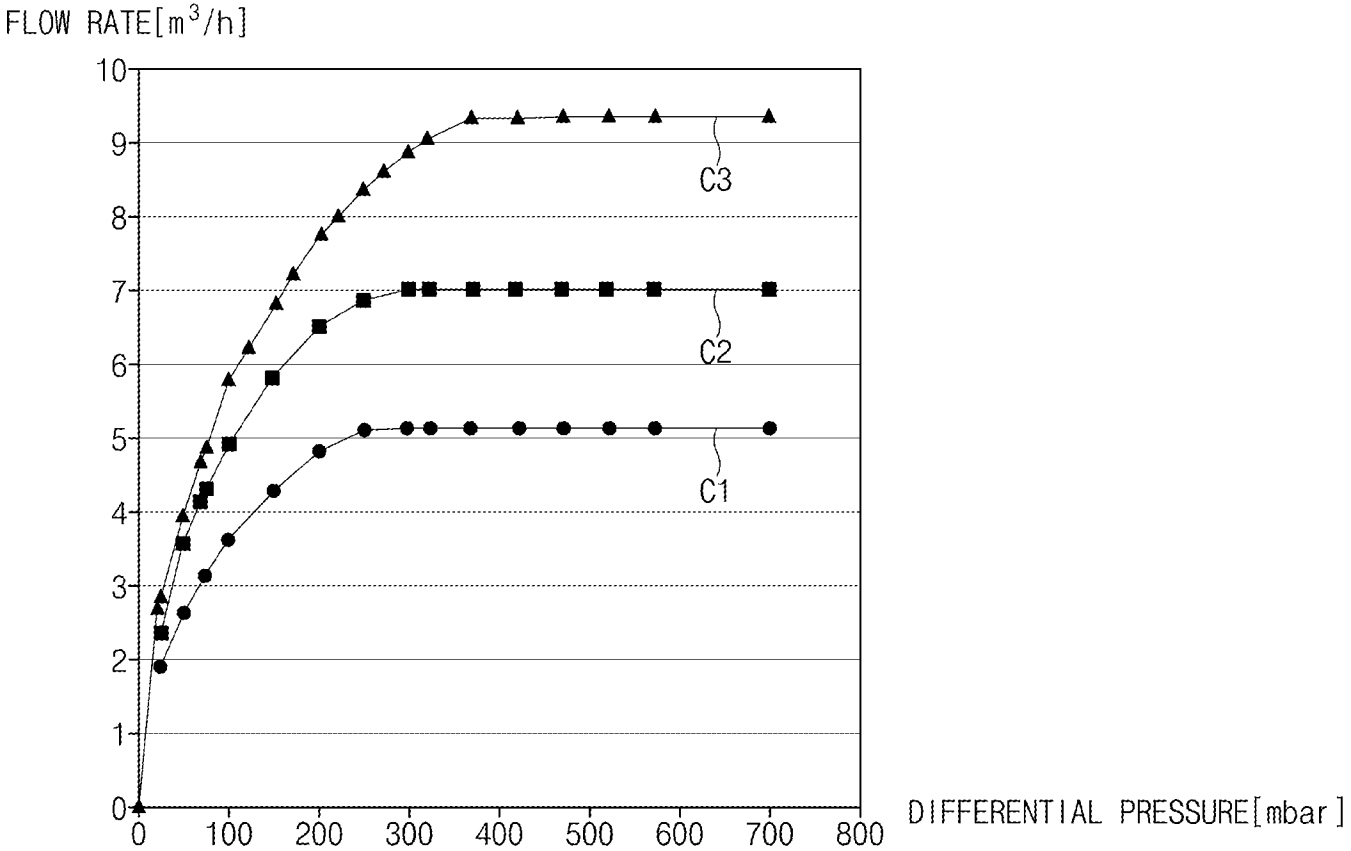
FIG. 2 is a graph depicting a relationship between a flow rate and a differential pressure for purge control valves with various specifications.

FIG. 2 is a graph depicting a relationship between a flow rate and a differential pressure for purge control valves 13 with various specifications.

FIG. 2 shows a differential pressure vs. flow rate curve C1 for a purge control valve with a first specification, a differential pressure vs. flow rate curve C2 for a purge control valve with a second specification, and a differential pressure vs. flow rate curve C3 for a purge control valve with a third specification. While the specific differential pressure vs. flow rate curves C1, C2, and C3 differ from one another depending on the specifications of the purge control valves, as shown in FIG. 2, the flow rate increases until the differential pressures of the purge control valves reach a predetermined pressure (about 300 mbar to about 350 mbar) and remains constant after the differential pressures of the purge control valves reach the predetermined pressure (about 300 mbar to about 350 mbar). As described above, the flow rate of fuel vapor passing through the purge control valve 13 may be determined depending on the differential pressure of the purge control valve 13 while the purge control valve 13 is open.

The purge pump 15 may be connected to the purge control valve 13 through the fourth conduit 24 and may be disposed downstream of the purge control valve 13 along the purge flow direction of the fuel vapor.

A negative pressure may be generated downstream of the purge control valve 13 when the purge pump 15 is driven, and the purge flow rate of the fuel vapor may be accurately controlled by adjusting the RPM of the purge pump 15 according to the flow rate determined by the purge control valve 13.

The purge pump 15 may have an inlet port 15*a* and an outlet port 15*b*. The inlet port 15*a* of the purge pump 15 may be in communication with the fourth conduit 24, and the outlet port 15*b* of the purge pump 15 may be in communication with a fifth conduit 25.

The purge pump 15 may be in communication with the intake system 7 of the engine 6 through the fifth conduit 25, and the fifth conduit 25 may be in communication with an intake pipe 7*a* of the intake system 7. Accordingly, the purge pump 15 may be located between the purge control valve 13 and the intake pipe 7*a*. A negative pressure may be generated at the outlet side of the purge control valve 13 (in the fourth conduit 24 in communication with the outlet port 13*b*) when the purge pump 15 is driven, and the purge control valve 13 may be driven according to a duty cycle to accurately control the purge flow rate of the fuel vapor purged to the intake system 7 of the engine 6.

A charger 8 may be provided on the intake pipe 7*a* and may be configured to compress ambient air introduced through an air inlet 7*c* of the intake pipe 7*a*. The charger 8 may be either a super charger or a turbo charger. The charger 8 implemented with a turbo charger is illustrated in FIG. 1. The turbo charger 8 may include a compressor 8*a* mounted on the intake pipe 7*a* of the engine 6 and a turbine 8*b* mounted on an exhaust pipe 9 of the engine 6. The compressor 8*a* may be connected to the turbine 8*b* through a common shaft 8*c*.

An inter-cooler 4 and a throttle assembly 3 may be provided on the intake pipe 7*a*. The inter-cooler 4 may be disposed downstream of the compressor 8*a* of the charger 8, and the throttle assembly 3 may be disposed downstream of the inter-cooler 4.

An oxygen sensor 9*c* may be provided on the exhaust pipe 9 and may be configured to measure the concentration of oxygen contained in an exhaust gas to measure an air/fuel (A/F) ratio.

The fifth conduit 25 may be connected to the intake pipe 7*a* upstream of the charger 8, and the fuel vapor may be purged upstream of the charger 8 from the canister 11. Since the fuel vapor is purged upstream of the charger 8, the fuel vapor, together with the ambient air, may be compressed by the charger 8, and thus combustion efficiency and fuel economy of the engine 6 may be significantly improved.

Referring to FIG. 1, the active canister purge system 10 according to a form of the present disclosure may include a pressure sensor 12 that measures pressure at the outlet side of the purge control valve 13. The pressure sensor 12 may be disposed between the purge control valve 13 and the purge pump 15 and may be configured to measure pressure at the outlet side of the purge control valve 13. The pressure sensor 12 may be implemented with a temperature-sensor-integrated pressure sensor with which a temperature sensor is integrated. Accordingly, the pressure sensor 12 may measure both pressure and temperature at the outlet side of the purge control valve 13.

The active canister purge system 10 according to a form of the present disclosure may include a controller 40 based on a microprocessor. The controller 40 may include a microprocessor or a central processing unit, a read only memory (ROM), a random access memory (RAM), an electrically programmable read only memory (EPROM), a high speed clock, and the like.

The controller 40 may be configured to control or manage an overall operation of the engine 6. The controller 40 may be an engine control unit or an engine control module.

The purge control valve 13, the pressure sensor 12, the purge pump 15, and the oxygen sensor 9*c* mounted on the exhaust pipe 9 of the engine 6 may be electrically connected to the controller 40.

Since the inlet port 13*a* of the purge control valve 13 is in communication with the canister 11 and the canister close valve 32 is usually open, pressure at the inlet side of the purge control valve 13 may be equal to or slightly higher than the atmospheric pressure, and pressure at the outlet side of the purge control valve 13 may be measured by the pressure sensor 12. Accordingly, the controller 40 may calculate or monitor a differential pressure of the purge control valve 13.

The controller 40 may determine a target purge flow rate, based on the amount (concentration) and air/fuel ratio of the fuel vapor trapped in the canister 11 and may set a target differential pressure that corresponds to the target purge flow rate determined based on the differential pressure vs. flow rate curves illustrated in FIG. 2. The controller 40 may adjust the RPM of the purge pump 15 by using PID control to allow the actual differential pressure of the purge control valve 13 to reach the set target differential pressure, thereby accurately controlling the purge flow rate of the fuel vapor.

Figure 3:
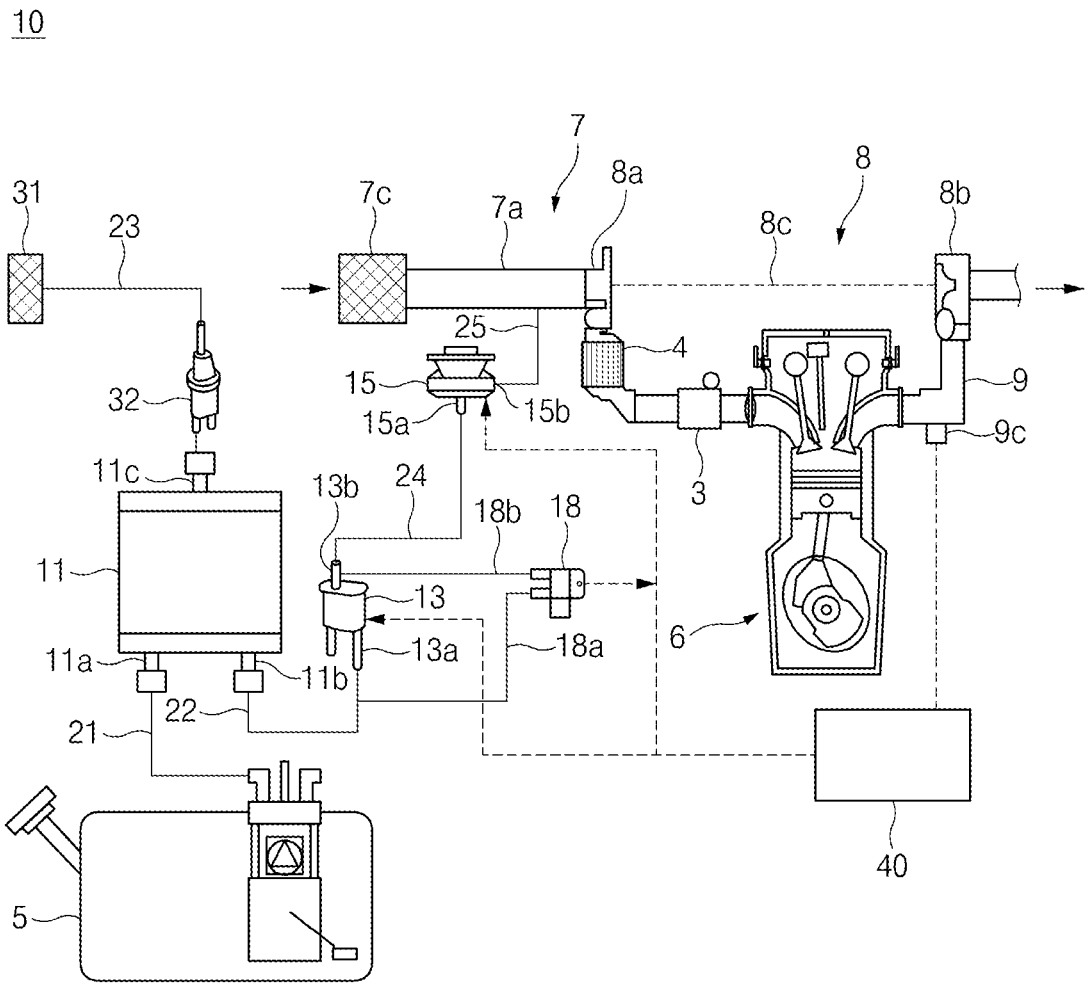
FIG. 3 illustrates a configuration of an active canister purge system according to another form of the present disclosure.

Referring to FIG. 3, an active canister purge system according to another form of the present disclosure may include a differential pressure sensor 18 that measures a difference between pressure at the inlet side of the purge control valve 13 and pressure at the outlet side of the purge control valve 13. The differential pressure sensor 18 may be connected to an upstream side and a downstream side of the purge control valve 13 through a first connecting tube 18*a* and a second connecting tube 18*b*. The first connecting tube 18*a* of the differential pressure sensor 18 may be connected to the second conduit 22 in communication with the inlet port 13*a* of the purge control valve 13, and the second connecting tube 18*b* of the differential pressure sensor 18 may be connected to the fourth conduit 24 in communication with the outlet port 13*b* of the purge control valve 13. A differential pressure of the purge control valve 13 (that is, a difference between pressure at the inlet side of the purge control valve 13 and pressure at the outlet side of the purge control valve 13) may be measured by the differential pressure sensor 18. The differential pressure sensor 18 may be electrically connected to the controller 40, and thus the controller 40 may more accurately calculate or monitor the differential pressure of the purge control valve 13.

Figure 4:
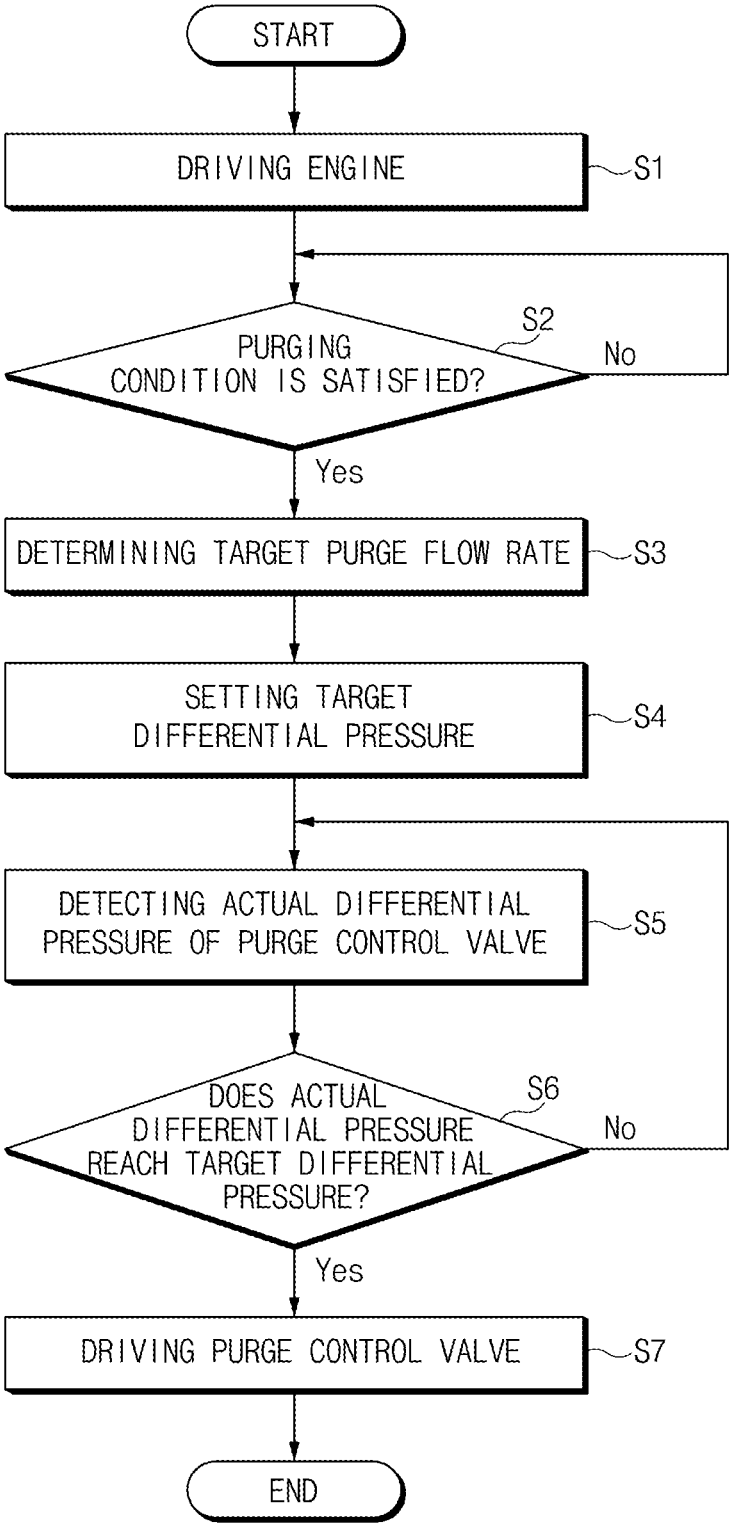
FIG. 4 is a flowchart illustrating a method for controlling an active canister purge system according to a form of the present disclosure.

FIG. 4 is a flowchart illustrating a method for controlling an active canister purge system according to a form of the present disclosure.

Referring to FIG. 4, the vehicle engine 6 may be driven (Step S1), and while the engine 6 is being driven, the controller 40 may determine whether a purging condition for purging fuel vapor from the canister 11 to the intake system 7 of the engine 6 is satisfied (Step S2). The controller 40 may determine whether the above-described purging condition is satisfied, based on the amount (concentration) of fuel vapor trapped in the canister 11 and engine control information, such as coolant temperature information, an air/fuel ratio, and the like, which are received from various types of sensors.

The controller 40 may determine a target purge flow rate depending on the amount (concentration) of fuel vapor trapped in the canister 11, an air/fuel ratio, and the like (Step S3) when determining that the purging condition is satisfied.

After the target purge flow rate is determined, the controller 40 may set a target differential pressure of the purge control valve 13 (that is, a difference between pressure at the inlet side of the purge control valve 13 and pressure at the outlet side of the purge control valve 13) that corresponds to the target purge flow rate, based on flow rate characteristics of the purge control valve 13 (see FIG. 2) (Step S4).

Since a differential pressure condition of the purge control valve 13 also changes with a variation in the temperature of ambient air, the controller 40 may preferably set the target differential pressure of the purge control valve 13 based on a temperature compensation value corresponding to the temperature change of the ambient air.

The controller 40 may drive the purge pump 15, and a negative pressure may be generated at the outlet side of the purge control valve 13 by driving the purge pump 15. The controller 40 may adjust the RPM of the purge pump 15 by using PID control to allow the actual differential pressure of the purge control valve 13 to reach the set target differential pressure.

The actual differential pressure of the purge control valve 13 may be changed in real time by adjusting the RPM of the purge pump 15, and the controller 40 may calculate or monitor the actual differential pressure of the purge control valve 13 in real time by using the pressure sensor 12 or the differential pressure sensor 18 (Step S5).

The controller 40 may determine whether the measured actual differential pressure of the purge control valve 13 reaches the set target differential pressure (Step S6).

When it is determined that the measured actual differential pressure of the purge control valve 13 reaches the set target differential pressure, the controller 40 may drive the purge control valve 40 according to a duty cycle set in advance (Step S7). Accordingly, the purge control valve 40 may be repeatedly opened and closed according to the set duty cycle, and the fuel vapor trapped in the canister 11 may be purged to the intake system 7 of the engine 6 at the purge flow rate determined in step S3.

Although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure.

Therefore, exemplary forms of the present disclosure are provided to explain the spirit and scope of the present disclosure, but not to limit them, so that the spirit and scope of the present disclosure is not limited by the forms. The scope of the present disclosure should be construed on the basis of the accompanying claims, and all the technical ideas within the scope equivalent to the claims should be included in the scope of the present disclosure.

What is claimed is:

1. An active canister purge system comprising:

a canister configured to trap fuel vapor generated in a fuel tank connected to an inlet port of the canister;

a purge control valve configured to purge the fuel vapor trapped in the canister to an intake system of an engine;

a purge pump disposed downstream of the purge control valve;

a pressure sensor configured to measure a pressure on an outlet side of the purge control valve; and a controller configured to determine a target purge flow rate of the fuel vapor trapped in the canister, to set a target differential pressure corresponding to the target purge flow rate, and to adjust a revolutions per minute (RPM) of the purge pump such that an actual differential pressure of the purge control valve, which is measured by the pressure sensor, reaches the target differential pressure, wherein:

an outlet port of the canister is connected to an inlet port of the purge control valve, and the pressure sensor is connected to an outlet port of the purge control valve, the purge control valve is connected to an inlet port of the purge pump, and when the actual differential pressure of the purge control valve reaches the target differential pressure, the controller is configured to maintain the target purge flow rate of the fuel vapor by repeatedly opening and closing the purge control valve.

2. The active canister purge system of claim 1, wherein the purge pump is in communication with an intake pipe of the engine through a conduit.

3. The active canister purge system of claim 2, wherein the conduit is connected to the intake pipe upstream of a charger.

4. The active canister purge system of claim 1, wherein a flow rate of the fuel vapor passing through the purge control valve is determined based on the differential pressure of the purge control valve.

5. A method for controlling an active canister purge system that includes a canister configured to trap fuel vapor generated in a fuel tank, a purge control valve configured to purge the fuel vapor trapped in the canister to an intake system of an engine, and a purge pump disposed downstream of the purge control valve, the method comprising:

measuring an actual differential pressure, by a differential pressure sensor, by detecting a pressure on an outlet side and an inlet side of the purge control valve, respectively, wherein an outlet port of the canister is connected to an inlet port of the purge control valve, and the fuel tank connected to an inlet port of the canister;

setting a target differential pressure of the purge control valve when a purging condition for purging the fuel vapor from the canister to the intake system of the engine is satisfied while the engine is being driven;

adjusting a revolutions per minute (RPM) of the purge pump such that the actual differential pressure of the purge control valve reaches the target differential pressure; and when the actual differential pressure of the purge control valve reaches the target differential pressure, maintaining a target purge flow rate of the fuel vapor by repeatedly opening and closing the purge control valve.

6. The method of claim 5, wherein the target differential pressure is set based on a temperature compensation value corresponding to a temperature change of ambient air.

7. The method of claim 5, further comprising:

determining the target purge flow rate of the purge control valve when the purging condition is satisfied while the engine is being driven, wherein the target differential pressure is set to correspond to the determined target purge flow rate.

8. The method of claim 5, wherein the actual differential pressure of the purge control system is measured in real time by the differential pressure sensor.

9. The method of claim 6, further comprising:

driving the purge control valve according to a duty cycle set in advance when the measured actual differential pressure of the purge control valve reaches the target differential pressure.

* * * * *